US009145229B2

(12) United States Patent
Hoorens Van Heijningen et al.

(10) Patent No.: US 9,145,229 B2
(45) Date of Patent: Sep. 29, 2015

(54) STEEL DRUM AND METHOD FOR MANUFACTURING SUCH A STEEL DRUM

(71) Applicant: Greif International Holding B.V., AK Vreeland (NL)

(72) Inventors: Diederik Cornelis Egbert Hoorens Van Heijningen, Europort (NL); Paulus Jozef Tamis, Velsen Noord (NL); Johannes Mulder, Velsen Noord (NL)

(73) Assignee: Greif International Holding B.V., AK Vreeland (NL)

( * ) Notice: Subject to any disclaimer, the term of this patent is extended or adjusted under 35 U.S.C. 154(b) by 0 days.

(21) Appl. No.: 14/362,317

(22) PCT Filed: Dec. 6, 2012

(86) PCT No.: PCT/NL2012/050855
§ 371 (c)(1),
(2) Date: Jun. 2, 2014

(87) PCT Pub. No.: WO2013/085382
PCT Pub. Date: Jun. 13, 2013

(65) Prior Publication Data

US 2014/0291336 A1 Oct. 2, 2014

(30) Foreign Application Priority Data

Dec. 7, 2011 (EP) ..... 11192404

(51) Int. Cl.

| | |
|---|---|
| ***B65D 6/38*** | (2006.01) |
| ***B21D 15/06*** | (2006.01) |
| ***B21D 17/00*** | (2006.01) |
| ***B21D 51/12*** | (2006.01) |
| ***B21D 51/20*** | (2006.01) |
| ***B65D 8/00*** | (2006.01) |

(52) U.S. Cl.
CPC *B65D 7/46* (2013.01); *B21D 15/06* (2013.01); *B21D 17/00* (2013.01); *B21D 51/12* (2013.01); *B21D 51/20* (2013.01); *B65D 7/045* (2013.01)

(58) Field of Classification Search
CPC ..... B65D 7/46; B65D 7/44; B65D 7/42
USPC ..... 220/672, 673, 670, 669; 413/1
See application file for complete search history.

(56) References Cited

U.S. PATENT DOCUMENTS

| | | | | | |
|---|---|---|---|---|---|
| 1,041,347 | A | * | 10/1912 | Potter | 220/4.06 |
| 1,649,292 | A | * | 11/1927 | Draper | 220/672 |
| 1,892,531 | A | * | 12/1932 | McKee | 220/672 |

(Continued)

*Primary Examiner* — Robert J Hicks
(74) *Attorney, Agent, or Firm* — Boyle Fredrickson, S.C.

(57) ABSTRACT

A steel drum (1) is manufactured from steel sheet and has a cylindrical shape with at least a bottom cover (4) in a sealed connection to the cylindrical shape. The steel drum includes a pattern of corrugations (7, 8) on the circumferential surface of the cylindrical shape (2). The pattern of corrugations (7, 8) includes a plurality of corrugations (7, 8) grouped in at least one cluster (5, 6, 14), and the corrugations (7, 8) have a substantially identical shape and size. Additionally, the invention relates to a method for manufacturing a steel drum (1) including: providing a steel sheet; creating a cylindrical shape from the steel sheet; creating a pattern of a plurality of corrugations (7, 8) on the cylindrical shape such that the corrugations (7, 8) are on the circumferential surface of the cylindrical shape (2) in at least one cluster (5, 6, 14), and providing each of the corrugations (7, 8) to have a substantially identical shape and size of corrugations (7, 8) in at least one cluster (5, 6, 14), and providing each of the corrugations (7, 8) to have a substantially identical shape and size.

9 Claims, 2 Drawing Sheets

(56) References Cited

U.S. PATENT DOCUMENTS 4,246,770 A * 1/1981 Franek et al. ..... 72/92
4,538,439 A * 9/1985 Frei ..... 72/105
5,730,315 A * 3/1998 Richoux ..... 220/672

* cited by examiner

STEEL DRUM AND METHOD FOR MANUFACTURING SUCH A STEEL DRUM

FIELD OF THE INVENTION

The present invention relates to a steel drum. Further the present invention relates to a method for manufacturing such a steel drum.

BACKGROUND

From the prior art a drum made out of steel sheet is blown. Such a drum has a substantially cylindrical shape with a closing cover at each end of the cylinder. Further the cylindrical surface of the drum is provided with corrugations in the circumferential direction. Each corrugation typically consists of an elevated region that is relatively elevated relative to the average cylinder radius and a deepened region that is relatively deepened relative to the average cylinder radius.

Currently, steel drums from the prior art are manufactured from a flat rectangular steel sheet, cut to size, that is rounded in one direction to form a cylindrical shape. The free ends of the steel sheet are brought together and are seamed or welded in the same process.

Next, the cylindrical shape is processed in a corrugator that produces the corrugations in the sheet in such a way that the corrugations each form an circular shape around the main axis of the cylinder.

The closing covers are typically attached to the steel cylinder by applying a folded seam. The folded seam may additionally be welded by electrical or radiative (i.e. laser) source. In case of an open head drum a cover can be arranged on the opening and fastened by means of a closing ring.

The corrugations in the cylindrical surface may be created by a rolling process or by a mechanical deformation of the cylindrical shape within a mould by exerting pressure on the wall of the cylindrical shape. Typically, two main beads are formed by exerting pressure. Between the two main beads a flat surface remains present while between each main bead and the respective closing end additional corrugations may be formed by rolling. The additional corrugations if present have smaller size than the main beads.

The corrugations provide a structural reinforcement that strengthens the drum against under-pressure.

Typically, the steel drum is divided by two main corrugations into a bottom cylindrical part, a center cylindrical part and a top cylindrical part, in which the center cylindrical part is substantially flat.

The bottom and top cylindrical parts may comprise additional corrugations that have a smaller depth (i.e., level difference between the elevated and deepened part) in comparison to the main corrugations.

Prior art steel drums are manufactured with various sizes and volumes. For use in container transport, steel drums have a cylindrical design and have a standardized diameter for optimal stacking in ISO standard containers. As an example, a typical internal diameter of such standardized steel drums according to ISO 15750 is about 570 mm (external diameter 585 mm), with a height of 850 mm, with a volume of nominal 216 liters.

A typical example of a steel drum for use in container transport is the well-known W-style bead type steel drum as described e.g. in U.S. Pat. No. 5,950,472, which provides a combination of a sufficient dynamic compression strength (during stacking) and a sufficient vacuum collapse strength.

To reduce the manufacturing costs per drum, there is a tendency to use steel sheet as thin as possible since less raw material and less energy costs per drum are needed. Additionally, using thinner steel sheet as raw material in the manufacturing of the drum will result in a lower weight per drum and lower energy costs of transport, since the ratio between the dead weight of the drum and the weight of the contents can be reduced further.

However an adverse effect may be that, using a thinner steel sheet, in particular 0.8 mm and thinner, will have a detrimental effect on the mechanical strength of the steel drum.

It is therefore an objective of the present invention, to provide a steel drum which has a relatively reduced weight while the mechanical performance is the same or better than for prior art steel drums.

SUMMARY OF THE INVENTION

The objective is achieved according to the present invention by a steel drum manufactured from steel sheet and having a cylindrical shape with at least a bottom cover in a sealed connection to the cylindrical shape, comprising a pattern of corrugations on the circumferential surface of the cylindrical shape, wherein the pattern of corrugations comprises a plurality of corrugations grouped in at least one cluster, and per cluster, the corrugations have a substantially identical shape and size; each corrugation consists of a peak portion and a valley portion, and a peak-to-valley depth of the corrugations is substantially constant; in the at least one cluster each peak portion has a substantially same curved peak shape, and each valley portion has a substantially curved valley shape; the peak radius being substantially equal to the valley radius.

Advantageously, the at least one cluster of corrugations provides an improved mechanical structural reinforcement of the wall of the drum in comparison to the W-style bead corrugation profile.

According to an aspect of the invention, there is provided a steel drum as described above, wherein a maximal height of the peak portion relative to the average wall level is substantially identical to the maximal height of the valley portion relative to the average wall level.

According to an aspect of the invention, there is provided a steel drum as described above, wherein at least one of the peak portion and the valley portion is defined as a curved segment with a variable radius of curvature.

According to an aspect of the invention, there is provided a steel drum as described above, wherein the peak portion is defined as a circular segment with a fixed peak radius and the valley portion is defined as a circular segment with fixed valley radius.

According to an aspect of the invention, there is provided a steel drum as described above, wherein the steel drum comprises two clusters of corrugations, one cluster being arranged in a top part of the cylindrical shape and the other cluster in bottom part, the top part being separated from the bottom part by a middle part of the cylindrical shape; the middle part being void of corrugations.

According to an aspect of the invention, there is provided a steel drum as described above, wherein the shape and/or size of the corrugations in one cluster differs from the shape and/or size respectively of the corrugations in the other cluster.

According to an aspect of the invention, there is provided a steel drum as described above, wherein the steel drum comprises a cluster of corrugations, the cluster being arranged in a middle part of the cylindrical shape, the top part being located in between a top part and a bottom part of the cylindrical shape; the top and bottom parts being void of corrugations.

According to an aspect of the invention, there is provided a steel drum as described above, wherein the peak radius and/or the valley radius is at least about 6 mm.

According to an aspect of the invention, there is provided a steel drum as described above, wherein the corrugations are located at a pitch of at least about 15 mm.

According to an aspect of the invention, there is provided a steel drum as described above, wherein the corrugation has a peak-to-valley depth between about 2.5 and about 6 mm.

Further, the present invention relates to a method for manufacturing a steel drum comprising:

providing a steel sheet; —creating a cylindrical shape from the steel sheet, —creating a pattern of a plurality of corrugations on the cylindrical shape such that the corrugations are on the circumferential surface of the cylindrical shape, wherein the method comprises: grouping the plurality of corrugations in at least one cluster, and providing each of the corrugations to have a substantially identical shape and size; providing per cluster, to let the corrugations have a substantially identical shape and size; each corrugation consisting of a peak portion and a valley portion, and a peak-to-valley depth of the corrugations is substantially constant; providing in the at least one cluster to let each peak portion have a substantially same curved peak shape, and to let each valley portion have a substantially same curved valley shape, and providing that the peak radius is substantially equal to the valley radius.

BRIEF DESCRIPTION OF DRAWINGS

The invention will be explained in more detail below with reference to drawings in which illustrative embodiments of the invention are shown. It will be appreciated by the person skilled in the art that other alternative and equivalent embodiments of the invention can be conceived and reduced to practice without departing from the true spirit of the invention, the scope of the invention being limited only by the appended claims.

In the following figures, the same reference numerals refer to similar or identical components in each of the figures.

DESCRIPTION OF EMBODIMENTS

Figure 1:
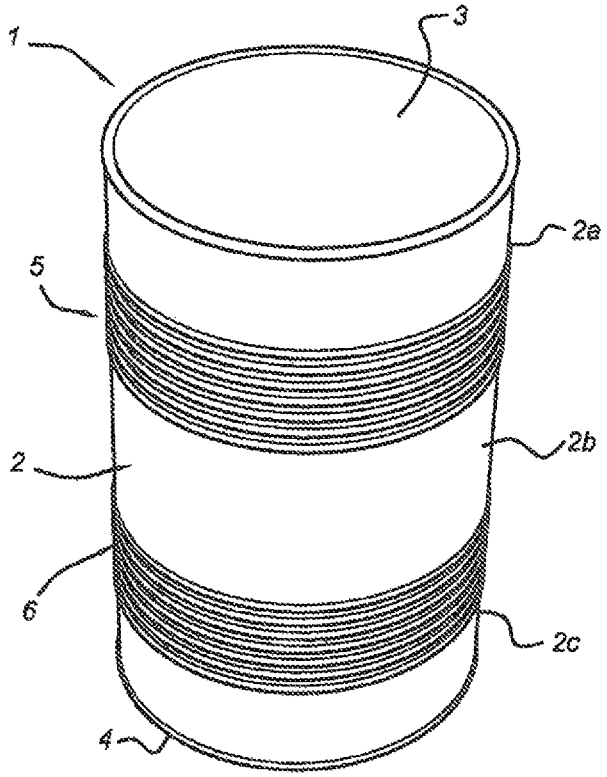
FIG. 1 shows a perspective view of a steel drum according to an embodiment of the present invention.

FIG. 1 shows a perspective view of a steel drum according to an embodiment of the present invention.

The steel drum 1 according to present invention has a cylindrical shape with at least a bottom cover 4, in a sealed connection with the cylindrical part 2. The cylindrical part 2 is made out of a steel sheet.

The cylindrical part 2 comprises on its circumferential surface a top and a bottom pan 2*a*, 2*c* each being provided with a cluster 5, 6 of a plurality of corrugations. The top and bottom parts are separated by a middle part 2*b* that is void of corrugations, substantially flat without a corrugation profile.

According to the present invention each cluster of corrugations comprises a plurality of substantially identically shaped and sized corrugations.

The pattern of corrugations in each cluster will be described in more detail with reference to FIG. 2, below.

Figure 2:
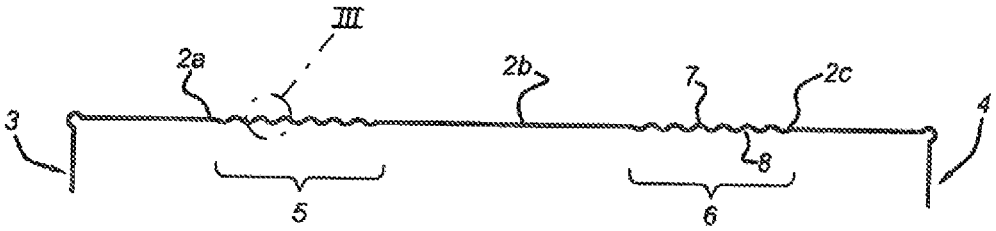
FIG. 2 shows a view of a corrugations profile of the steel drum of FIG. 1.

FIG. 2 shows a cross-sectional view of a core corrugations profile in the wall of the steel drum of FIG. 1.

In FIG. 2, the cylindrical main axis of the steel drum is shown horizontally.

In the top part 2*a* and bottom part 2*c*, the corrugations in each cluster are substantially identical to each other.

It is to be understood that the corrugations of the one cluster and the other cluster may be substantially identical for both clusters, but that it is also feasible that the substantially identical corrugations in one cluster may differ from the substantially identical corrugations in the other cluster.

Each corrugation consists of a peak portion 7 (elevated with respect to an average wall level or position) and a valley (or lowered) portion 8. The peak-to-valley depth of the corrugations is substantially constant.

In an embodiment, the maximal height of the peak portion relative to the average wall level is substantially identical to the maximal height of the valley portion relative to the average wall level.

The peak portions each have a substantially same curved peak shape in the direction parallel to the main axis of the cylindrical shape, and so have the valley portions a same curved valley shape. The curvature of the peak portions is however not necessarily identical to the curvature of the valley portions.

Also, the curvature of each peak portion and/or the valley portion may not be constant over the width of the peak portion and/or the valley portion, respectively.

In a further embodiment, the peak portion is defined as a circular segment with a fixed peak radius R1 and the valley portion is defined as a circular segment with fixed valley radius R2.

In yet a further embodiment, the peak radius R1 is substantially equal to the valley radius R2.

Figure 3:
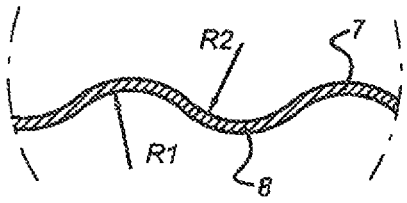
FIG. 3 shows a detail of the corrugations profile according to an embodiment of the invention.

FIG. 3 shows a detail of the corrugations profile according to an embodiment of the invention.

The number of corrugations in the cluster in the top part 2*a* of the drum is preferably the same as the number of corrugations in the bottom part 2*c* of the drum.

Both the peak and valley radius and the pitch of the corrugations within each cluster that can be achieved are determined mainly by the plastic and elastic deformability and strengthening of the steel sheet during the corrugation process.

In an exemplary embodiment, the steel sheet has a thickness of nominal 0.8 (0.75-0.85) mm. Each corrugation has a peak-to-valley depth selected from the range of 2.5-6 mm, averaged over the circumference at at least three measuring points.

In an embodiment the peak radius R1 is selected as minimally (i.e. at least) about 6 mm. Likewise, the valley radius R2 is selected as minimally about 6 mm.

In a further embodiment, the peak radius R1 may be equal to the valley radius R2.

In an alternative embodiment the valley radius R2 is chosen different from the peak radius R1, with either R1 or R2 having the minimal radius of about 6 mm.

The corrugations within the cluster are located at a minimal pitch of about 15 mm. The number of corrugations in each cluster is minimally five.

It is noted that the peak-to-valley depth of the corrugations may show a variation caused by variations of the mechanical properties of the steel sheet and of the manufacturing process as will be appreciated by the sidled person.

The corrugation cluster in the top part 2*a* and the corrugation cluster in the bottom part 2*c* are separated by the flat middle part 2*b*.

The flat middle part 2*b* may advantageously be used as printable area of the drum.

It is noted that the shape and/or size of the corrugations in one of the clusters may be designed to differ from the shape and/or size respectively of the corrugations in the other cluster.

It is observed that for a same wall thickness (i.e. the thickness of the steel sheet), the steel drum 1 of the present invention has better mechanical performance than the steel drum from the prior art having only two corrugations or having two main corrugations and a number of minor corrugations.

Additionally, it is observed that a steel drum with a relatively thinner wall thickness the steel drum according to the present invention has mechanical performance at least equal to that of the aforementioned steel drum from the prior art.

As an example to illustrate an improvement of mechanical performance, in table 1 and table 2 experimental data are shown for steel drums according to an exemplary embodiment of the present invention and compared with experimental data for prior art W-style bead steel drums, with standardized internal diameter of 570 mm (external diameter 585 mm), ISO 15750.

The experimental data relate to a dynamic compression test (along the cylindrical main axis) with even load and no underpressure in the drum and to a vacuum collapse test.

The test data show results for steel drums with a nominal thickness of 0.9 mm and a nominal thickness of 0.8 mm.

The steel drums according to this exemplary embodiment have corrugations in two clusters (in top and bottom part) with for a steel sheet thickness of 0.9 mm an average peak-to-valley depth of 2.9 mm, 8 corrugations per cluster, and for a steel sheet thickness of nominal 0.8 mm an average peak-to-valley depth of 3.7 mm, 8 corrugations per cluster.

TABLE 1 dynamic compression test (load at collapse, even load, no underpressure) for steel drums of invention having two clusters of corrugations and for prior art W-style bead drums.

| Thickness (mm) | Load (kN) example embodiment | Load (kN) prior art steel drum |
|---|---|---|
| 0.9 | 57 | 34 |
| 0.8 | 37 | 26 |

TABLE 2 vacuum collapse test (pressure at collapse [bar]) for steel drums of invention and for prior art W style bead drums; no external loading

| Thickness (mm) | Pressure (bar) example embodiment | Pressure (bar) prior art |
|---|---|---|
| 0.9 | −0.70 | −0.66 |
| 0.8 | −0.69 | −0.58 |

Figure 4:
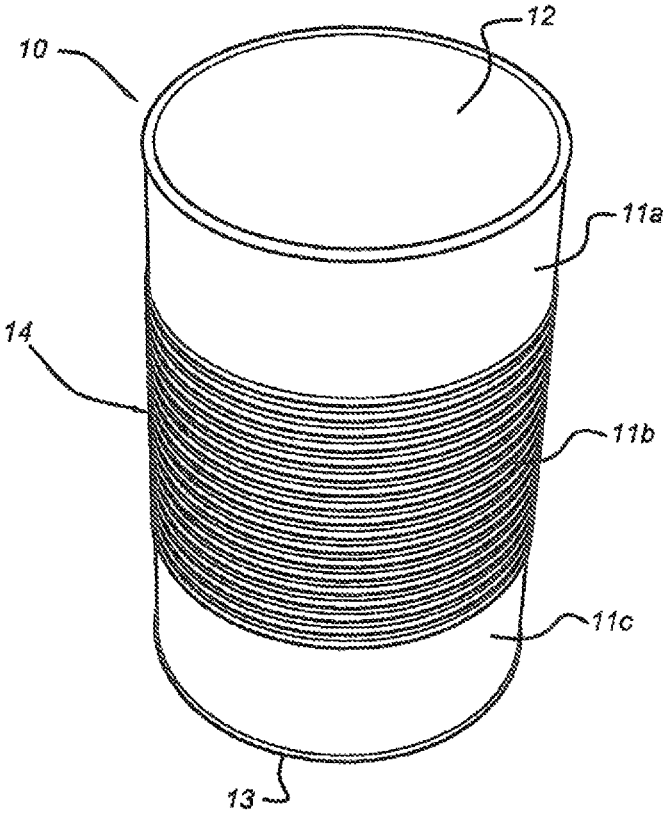
FIG. 4 shows a perspective view of a steel drum according to an embodiment of the present invention.

FIG. 4 shows a perspective view of a steel drum according to an embodiment of the present invention.

In this embodiment, the steel drum 10 has a cylindrical shape with at least a bottom cover 4, in a sealed connection with the cylindrical part 11. The cylindrical part 11 is made out of a steel sheet.

The cylindrical part 11 comprises on its circumferential surface a top and a bottom part 11*a*, 11*c* and a middle part 11*b* being provided with one cluster pattern 14 of corrugations. The top and bottom parts are void of corrugations, substantially flat without a corrugation profile.

According to the present invention each pattern of corrugations comprises a plurality of substantially identically shaped and sized corrugations.

The pattern of corrugations in the cluster will be described in more detail with reference to FIG. 4, below.

Figure 5:
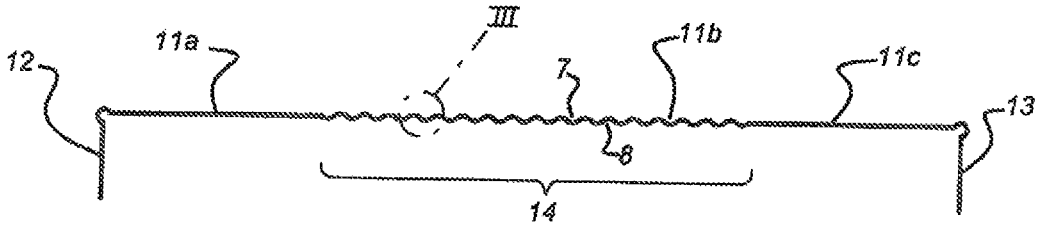
FIG. 5 shows a view of a corrugations profile of the steel drum of FIG. 4.

FIG. 5 shows a view of a corrugations profile of the steel drum of FIG. 4.

In FIG. 5, the cylindrical main axis of the steel drum is shown horizontally.

In the middle part 11*b*, the corrugations in the cluster are substantially identical to each other. Each corrugation consists of a peak portion 7 and a valley portion 8. The peak-to-valley depth of the corrugations is substantially constant.

In an embodiment, the maximal height of the peak portion relative to the average wall level is substantially identical to the maximal height of the valley portion relative the average wall level.

In a further embodiment, the peak portion is defined as a circular segment with a fixed peak radius R1 and the valley portion is defined as a circular segment with fixed valley radius R2.

In yet a further embodiment, the peak radius R1 is substantially equal to the valley radius R2.

FIG. 3 shows a detail of the corrugations profile according to an embodiment of the invention.

In an exemplary embodiment, the steel sheet has a thickness of 0.8 (0.75-0.85) mm. Each corrugation has a peak-to-valley depth selected from the range of 2.5-6 mm. The peak radius R1 is selected as minimally about 6 mm and equal to the valley radius R2. The corrugations are located at a minimal pitch of about 15 mm. The number of corrugations is chosen in dependence of the available space on the drum and the size/pitch. In an example, the number of corrugations in each cluster is chosen between 10 and 40, for example 20.

The corrugations may show some variation of the peak-to-valley depth due to variations of the mechanical properties of the steel sheet and of the manufacturing process as will be appreciated by the skilled person.

In dependence on the mechanical performance to be obtained other embodiments are feasible.

In an alternative embodiment, the thickness of the steel sheet is a minimum of 0.5 mm.

The above described steel drums can be manufactured by a corrugator machine that creates a steel drum with at least one cluster of corrugations from a steel sheet.

According to an aspect, the present invention relates to a method for manufacturing a steel drum comprising:

providing a steel sheet;

creating a cylindrical shape from the steel sheet, creating a pattern of a plurality of corrugations on the cylindrical shape such that the corrugations are on the circumferential surface of the cylindrical shape, wherein the method comprises: grouping the plurality of corrugations in at least one cluster, and providing each of the corrugations to have a substantially identical shape and size.

The embodiments as described above present examples of steel drums with numerical specifications such as size, diameter and wall thickness to illustrate the invention. It is noted that the steel drum according to the present invention is not limited to embodiments with these specifications. Steel drums with other dimensions are conceivable as well within the scope of the invention.

It will be apparent to the person skilled in the art that other embodiments of the invention can be conceived and reduced to practice without departing from the true spirit of the invention, the scope of the invention being limited only by the appended claims as finally granted. The description is not intended to limit the invention.

The invention claimed is:

1. Steel drum manufactured from steel sheet and having a cylindrical shape with a circumferential surface with at least a bottom cover in a sealed connection to the cylindrical shape, comprising:

a plurality of corrugations on the circumferential surface of the cylindrical shape, the plurality of corrugations includes a plurality of corrugations grouped in at least two clusters;

wherein:

per cluster, each corrugation has a profile of an identical shape and size;

per cluster, the shape and size of each corrugation are constant around the circumferential surface of the steel drum;

each corrugation includes a peak portion and a valley portion, and a peak-to-valley depth of the corrugations is constant;

in the at least one cluster each peak portion has a same curved peak shape, each valley portion has a substantially same curved valley shape;

a peak radius being substantially equal to a valley radius;

the peak portion being defined as a circular segment with a fixed peak radius and the valley portion being defined as a circular segment with a fixed valley radius; and the shape and/or size of the corrugations in a first cluster differs from the shape and/or size respectively of the corrugations in a second cluster.

2. Steel drum according to claim 1, wherein a maximal height of the peak portion relative to the average wall level is substantially identical to the maximal height of the valley portion relative to the average wall level.

3. Steel drum according to claim 1, wherein at least one of the peak portion and the valley portion is defined as a curved segment with a variable radius of curvature.

4. Steel drum according to claim 1, wherein the first cluster is arranged in a top part of the cylindrical shape and the second cluster in bottom part, the top part being separated from the bottom part by a middle part of the cylindrical shape; the middle part being void of corrugations.

5. Steel drum according to claim 1, wherein the peak radius and/or the valley radius is at least about 6 mm.

6. Steel drum according to claim 5, wherein the corrugations are located at a pitch of at least about 15 mm.

7. Steel drum according to claim 1, wherein the corrugation has a peak-to-valley depth between about 2.5 and about 6 mm.

8. Method for manufacturing a steel drum comprising:

providing a steel sheet;

creating a cylindrical shape from the steel sheet;

creating a pattern of a plurality of corrugations on the cylindrical shape such that the corrugations are on the circumferential surface of the cylindrical shape, wherein the step for creating the pattern includes the steps of:

grouping the plurality of corrugations in at least two clusters;

providing per cluster, to let the corrugations have a substantially identical shape and size, each corrugation including a peak portion and a valley portion and the size and shape of each corrugation is constant around the circumferential surface of the cylindrical shape, and a peak-to-valley depth of the corrugations is substantially constant;

providing in the at least one cluster to let each peak portion have a substantially same curved peak shape, and to let each valley portion have a substantially same curved valley shape; and providing that a peak radius is substantially equal to a valley radius; wherein:

each peak portion being defined as a circular segment with a fixed peak radius;

each valley portion is defined as a circular segment with a fixed valley radius; and the shape and/or size of the corrugations in a first cluster differs from the shape and/or size respectively of the corrugations in a second cluster.

9. Steel drum according to claim 1, wherein:

the steel drum has a sheet thickness of 0.9 mm or less;

the peak radius and/or the valley radius is at least about 6 mm;

per cluster, the number of corrugations is at least 8;

the corrugations are located at a pitch of at least about 15 mm; and the corrugations have a peak-to-valley depth between about 2.5 and about 6 mm.

* * * * *